US008505564B2

(12) United States Patent
Kuo

(10) Patent No.: US 8,505,564 B2
(45) Date of Patent: Aug. 13, 2013

(54) AUTOMATIC FOLDING/UNFOLDING UMBRELLA

(76) Inventor: Chih-Ju Kuo, Ji'an Township (TW)

( * ) Notice: Subject to any disclaimer, the term of this patent is extended or adjusted under 35 U.S.C. 154(b) by 50 days.

(21) Appl. No.: 13/190,013

(22) Filed: Jul. 25, 2011

(65) Prior Publication Data

US 2012/0125388 A1 May 24, 2012

(30) Foreign Application Priority Data

Nov. 22, 2010 (TW) ..... 99140254 A

(51) Int. Cl.
*A45B 25/16* (2006.01)
*A45B 19/00* (2006.01)

(52) U.S. Cl.
USPC ..... 135/23; 135/24; 135/25.34

(58) Field of Classification Search
USPC ..... 135/20.3, 23, 25.33, 25.34
See application file for complete search history.

(56) References Cited

U.S. PATENT DOCUMENTS 805,957 A * 11/1905 Hoffman ..... 135/25.31
897,195 A * 8/1908 Dague ..... 135/25.32
1,161,139 A * 11/1915 Larsson ..... 135/25.33
1,264,010 A * 4/1918 Calusinski ..... 135/25.3
3,508,560 A * 4/1970 Kitani ..... 135/20.3
3,565,087 A * 2/1971 Choji Arai et al. ..... 135/23
3,732,882 A * 5/1973 Kida et al. ..... 135/25.33
3,802,452 A * 4/1974 Weber ..... 135/26
3,848,740 A * 11/1974 Weber ..... 135/25.3
5,913,321 A * 6/1999 Yung ..... 135/24

* cited by examiner

*Primary Examiner* — Noah Chandler Hawk
(74) *Attorney, Agent, or Firm* — Wang Law Firm, Inc.; Li K. Wang; Stephen Hsu

(57) ABSTRACT

An automatic folding/unfolding umbrella includes a main rod, umbrella ribs for supporting a canopy, a slide element, and a handle. The umbrella ribs are pivotally installed at the tip of the main rod, and primary link rods are pivotally installed under the tip of the main rod. A secondary link rod is pivotally coupled between each corresponding umbrella rib and each primary link rod. The slide element is installed on the main rod. A handle installed at a bottom end of the main rod includes a link mechanism. The main rod includes a link element and a link mechanism coupled to the slide element. Elastically stretchable elements couple the slide element with the primary link rod. The link mechanism is driven by the link element to slide the slide element. The elastically stretchable elements are pulled to drive the primary link rods to unfold or fold the umbrella ribs.

11 Claims, 17 Drawing Sheets

AUTOMATIC FOLDING/UNFOLDING UMBRELLA

BACKGROUND OF THE INVENTION

1. Field of the Invention

The present invention relates to an umbrella, and more particularly to an umbrella structure that can be folded and unfolded automatically by using one hand.

2. Brief Description of the Related Art

At early stage, a user needs to hold a handle of an umbrella and push a link rod upward by extending another hand into umbrella ribs, such that a canopy is spread open with the umbrella ribs in order to use the umbrella, and then the user needs to pull the link rod downward for folding the umbrella after use. Since the process of folding or unfolding the umbrella of this sort requires operations of both hands, it may cause problems or inconvenience to the user who is holding other objects with one hand, or whose hand is injured. Therefore, an automatic folding/unfolding umbrella that requires one-hand operation was introduced into the market.

Although some conventional umbrellas requiring one-hand operation can be folded and unfolded automatically, yet the structure and operation of these umbrellas still require further improvements. The automatic folding/unfolding umbrellas as disclosed in the following patents are given as examples to show that there is a need for improvements.

1. An automatic foldable umbrella as disclosed in R.O.C. Pat. No. 283,319 only requires one hand for the operation of the umbrella to achieve the automatic folding and unfolding effects. However, this umbrella requires an inner tube retracted into an outer tube first, and then a latch is released to eject a spring installed in the inner tube in order to unfold the umbrella. In other words, this umbrella still requires both hands for operating the umbrella and causes inconvenience to the folding and unfolding operation of the umbrella.

2. An umbrella with an automatic folding and unfolding structure as disclosed in R.O.C. Pat. No. I317,269 can be operated by one hand to achieve the automatic folding and unfolding effect, but the umbrella adopts a two-section pressing design for folding and unfolding the umbrella. If the user wants to unfold the umbrella again, the spring has to restore its original compressed condition, so that the operation of the umbrella still requires both hands and also incurs problems and inconvenience to the user.

3. An automatic umbrella device (II) as disclosed in R.O.C. Pat. No. 454,462 can be operated by one hand to achieve the folding and unfolding effects, but the principle of operating the umbrella is unlike the general habit of using the umbrella. As to its structure, the total weight of this umbrella is heavier than the weight of the general umbrellas, so that this umbrella is still inconvenient to use.

4. An improved umbrella control device as disclosed in R.O.C. Pat. No. M305,601 allows an umbrella to be operated by one hand to achieve the folding and unfolding effects, yet the operation of folding or unfolding the umbrella is controlled simply by a coiling wire with a sufficient length, and it takes some effort to pull a link rod by the coiling wire, so that this umbrella is still inconvenient to use.

5. An automatic folding/unfolding umbrella with a clutch device as disclosed in R.O.C. Pat. No. 283,319 and an automatic foldable umbrella as disclosed in R.O.C. Pat. No. 571,657 and an automatic folding and unfolding umbrella as disclosed in R.O.C. Pat. No. 578,471 can be operated by one hand to achieve the automatic folding and unfolding effects, but these three types of umbrellas have complicated components, not only incurring a higher cost, but also having a significantly higher damage rate of components and a higher level of difficulty for repair and maintenance.

In each of the foregoing prior arts, the umbrella structure comes with complicated components, inconvenient operations, and high cost. Obviously, each prior art requires a main rod, and a link rod base linked to a link rod, wherein the slide stroke for folding or unfolding the umbrella exceeds half of the length of the main rod, meaning that the link rod base requires a long slide stroke and thus takes relatively longer time to fold or unfold the umbrella, and requires more effort to drive the umbrella by one hand.

SUMMARY OF THE INVENTION

Therefore, it is a primary objective of the present invention to overcome the aforementioned drawbacks of the prior art by providing an automatic folding/unfolding umbrella with simple components to lower the cost, and a design of the umbrella with a labor-saving structure capable of folding and unfolding an umbrella automatically and easily.

To achieve the foregoing objective, the present invention provides an automatic folding/unfolding umbrella, comprising:

a main rod, being a single rod or comprised of two or more rods that can be stretchably and contractible installed;

a plurality of umbrella ribs, each having an end pivotally coupled to the tip of the main rod, and disposed around the main rod for supporting a canopy, and each of the umbrella ribs being a single rod or composed of two or more rods foldably coupled to one another, and the plurality of primary link rods being installed under the tip of the main rod and corresponding to the umbrella ribs respectively, and each umbrella rib and each corresponding primary link rod having a fixed distance apart from one another at the pivotally coupled position of the main rod, and each primary link rod being swung in a same direction as the corresponding umbrella rib;

a plurality of secondary link rods, each secondary link rod having an end pivotally coupled to an end of the primary link rod, and another end of each secondary link rod being pivotally installed to the corresponding umbrella rib, and each secondary link rod linking the corresponding umbrella rib when the primary link rod swings;

a slide element, axially and slidably installed at the main rod, and being slidable between upper and lower positions wherein the primary link rods are pivotally installed at the main rod;

a handle, installed at the bottom of the main rod, and having a link mechanism installed in the main rod and coupled to the slide element by at least one link element, for driving the slide element to slide up and down, and the slide element being abutted by an elastic element to provide a reaction for resuming the slide element to its original position after the link element is driven; and a plurality of elastically stretchable elements, each corresponding to each of the primary link rods, and an end of each elastically stretchable element being coupled to an end of the secondary link rod which is pivotally coupled to the primary link rod, and another end of each elastically stretchable element being coupled to the slide element, and the slide element being displaced up and down at a position where the main rod is pivotally coupled to the plurality of primary link rods.

BRIEF DESCRIPTION OF THE INVENTION

DETAILED DESCRIPTION OF THE PREFERRED EMBODIMENTS

Figure 1:
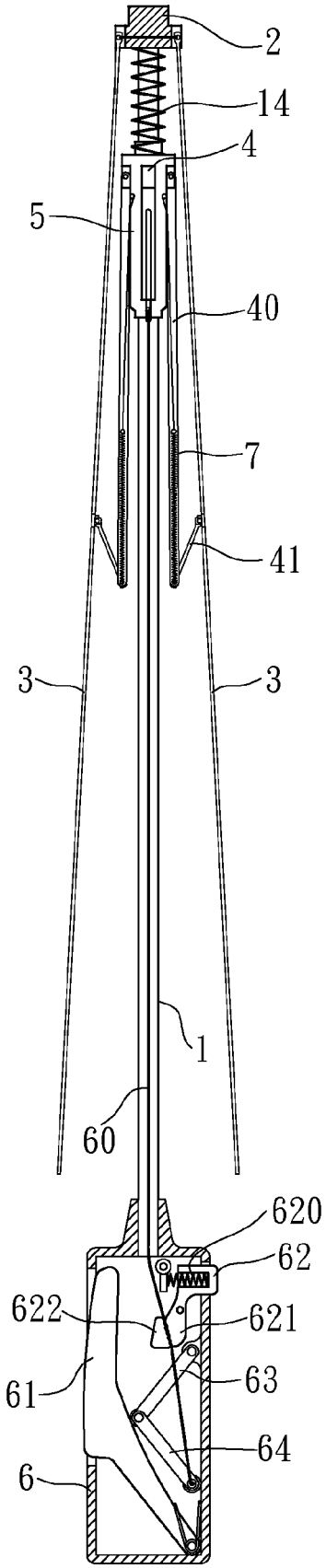
FIG. 1 is a schematic view of an umbrella of a first preferred embodiment of the present invention.

The technical contents of the present invention will become apparent by the detailed description of the preferred embodiments together with the illustration of related drawings as follows:

With reference to FIG. 1 for an automatic folding/unfolding umbrella of the first preferred embodiment of the present invention, the automatic folding/unfolding umbrella comprises a main rod 1, an umbrella rib base 2, a plurality of umbrella ribs 3, a link rod base 4, a slide element 5, a handle 6 and a plurality of elastically stretchable elements 7.

In FIG. 1, the main rod 1 of this preferred embodiment is a single rod, and the umbrella rib base 2 is disposed at the tip of the main rod 1, and an end of each of the umbrella ribs 3 is pivotally installed around the periphery of the umbrella rib base 2 and drooped from the main rod 1 to support a canopy, and each umbrella rib 3 of this preferred embodiment is a single rod.

Figure 2:
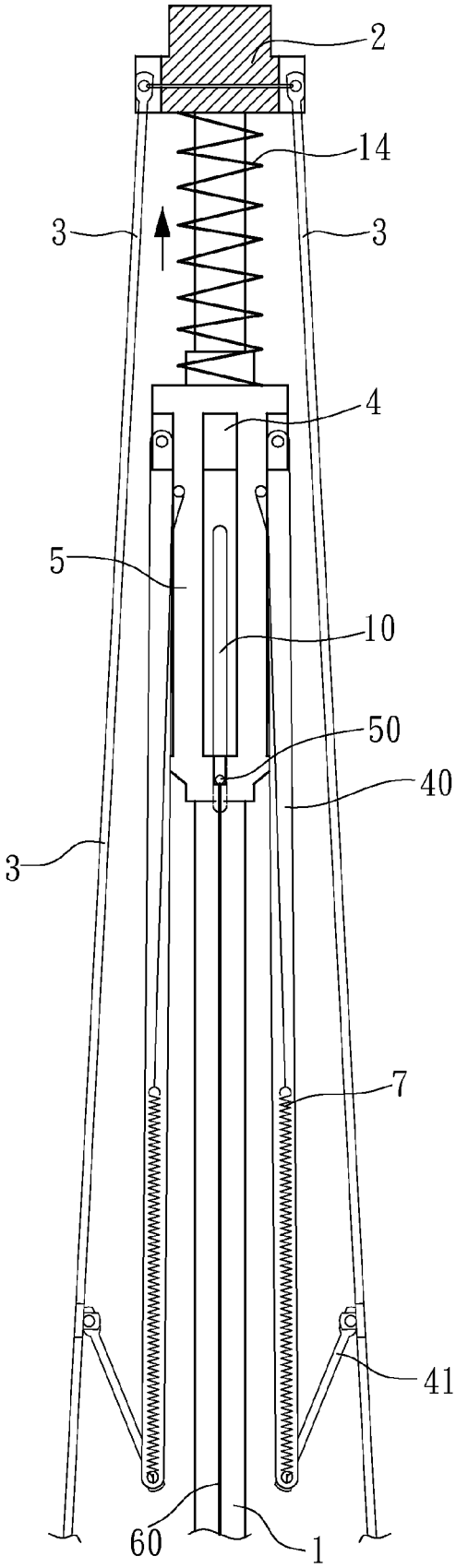
FIG. 2 is a schematic view of a connecting portion of umbrella ribs of an umbrella in accordance with the first preferred embodiment of the present invention.

In FIGS. 1 and 2, the link rod base 4 is disposed on the main rod 1, near the umbrella rib base 2, and under the umbrella rib base 2. The distance between the link rod base 4 and the umbrella rib base 2 on the main rod 1 is fixed, and the link rod base 4 disposed around the relative position of each of the umbrella ribs 3 is pivotally coupled to a primary link rod 40, and the pivotal swinging direction of each primary link rod 40 is the same as that of the umbrella rib 3, and each of the umbrella ribs 3 and the corresponding primary link rod 4 are coupled by a secondary link rod 41, wherein an end of each secondary link rod 41 is pivotally coupled to an end of the primary link rod 40, and another end of each secondary link rod 41 is pivotally coupled to an umbrella rib 3, and each secondary link rod 41 links to the corresponding umbrella rib 3 when the primary link rod 40 is swung. Obviously, the corresponding umbrella rib 3, primary link rod 40, secondary link rod 41, and main rod 1 are coupled by a quadrilateral structure when the umbrella is unfolded.

In FIG. 2, the slide element 5 is installed on the main rod 1 and disposed outside the link rod base 4, an elastic element 14 is provided for coupling the slide element 5 to the umbrella rib base 2 at the tip of the main rod 1, wherein the elastic element 14 of this preferred embodiment is a stretchable spring, and provided for the slide element 5 to be pulled in a direction towards the umbrella rib base under normal conditions.

As shown in FIG. 1, the handle 6 is installed at the bottom of the main rod 1, and the handle 6 of this preferred embodiment includes a link mechanism installed thereon, and the link mechanism is coupled to the slide element 5 by at least one link element 60 in the main rod 1, and the link element 60 drives the slide element 5 to slide up and down.

Each elastically stretchable elements 7 is coupled between the slide element 5 and each of the primary link rods 40, and each elastically stretchable element 7 corresponds to each primary link rod 40, and an end of each elastically stretchable element 7 is coupled to a position where the primary link rod 40 is pivotally coupled to an end of the secondary link rod 41, and another end of each elastically stretchable element 7 is coupled to the slide element 5, and each elastically stretchable element 7 coupled to the slide element 5 displaces up and down with the slide element 5.

As shown in FIG. 2, the main rod 1 of this preferred embodiment includes a long slot 10 formed at an opposite position of the slide element 5 and axially penetrated through the main rod 1, and a limit rod 50 is passed into the bottom of the slide element 5 and penetrated through the long slot 10, and the limit rod 50 is provided for coupling the link element 60 in the main rod 1, wherein the sliding stroke of the slide element 5 is the sliding distance between both ends of the long slot 10 when the limit rod 50 is linked by the link element 60. When the limit rod 50 is situated under the long slot 10, the position of coupling each of the elastically stretchable elements 7 to the slide element 5 is lower than the position where the link rod base 4 is pivotally coupled to each primary link rod 40. When the limit rod 50 is moved upward from the bottom of the long slot 10, the slide element 5 is linked to move upward, so that the position of coupling each of the elastically stretchable elements 7 to the slide element 5 is higher than the position where the link rod base 4 is pivotally coupled to each primary link rod 40. When the slide element 5 of this preferred embodiment is extended linearly from the bottom towards the link rod base 4 and the slide element 5 slides up and down, each the elastically stretchable element 7 at the coupling position of the slide element 5 also slides linearly up and down.

As shown in FIG. 1, the link element 60 of this preferred embodiment is a pull string, and the link element 60 is passed through the main rod 1 and coupled to the limit rod 50, and the link mechanism includes a press switch 61 and a release switch 62 installed on the handle 6, and ends of two extension rods 63, 64 in the handle 6 can be slidably contacted to a sidewall of the press switch 61, and an end of the extension rod 63 is upwardly and pivotally coupled to a fixed position of the handle 6, and an end of the other extension rod 64 is downwardly and slidably contacted to a sidewall of the handle 6 and coupled to the bottom of the link element 60; the release switch 62 is installed at the top of the two extension rods 63, 64 of the handle 6, and the release switch 62 of the handle 6 is pushed by a compression spring 620, and a clamp member 621 is extended from the bottom of the release switch 62, and a corresponding clamp base 622 is disposed at a link element 60 and opposite to a lateral side of the clamp member 621, and the link element 60 is passed between the clamp member 621 and the clamp base 622, and teeth are formed on the clamp base 622 and disposed opposite to the clamp member 621 for clamping the link element 60. When the press switch 61 is pressed, an end of the extension rod 64 is driven to move downward and pull the link element 60 downward. When the link element 60 stops being pulled, the link element 60 is clamped and fixed by the clamp member 621 and the clamp base 622. Now, the press switch 61 is linked by the two extension rods 63, 64 and pressed inwardly, so that the release switch 62 can be pressed to separate the clamp member 621 from the clamp base 622, and the slide element 5 is pulled back by the elastic element 14 to pull the link element 60 downward together with the slide element 5. Now, the press switch 61 is moved upward and outwardly together with the extension rod 64.

Figure 3:
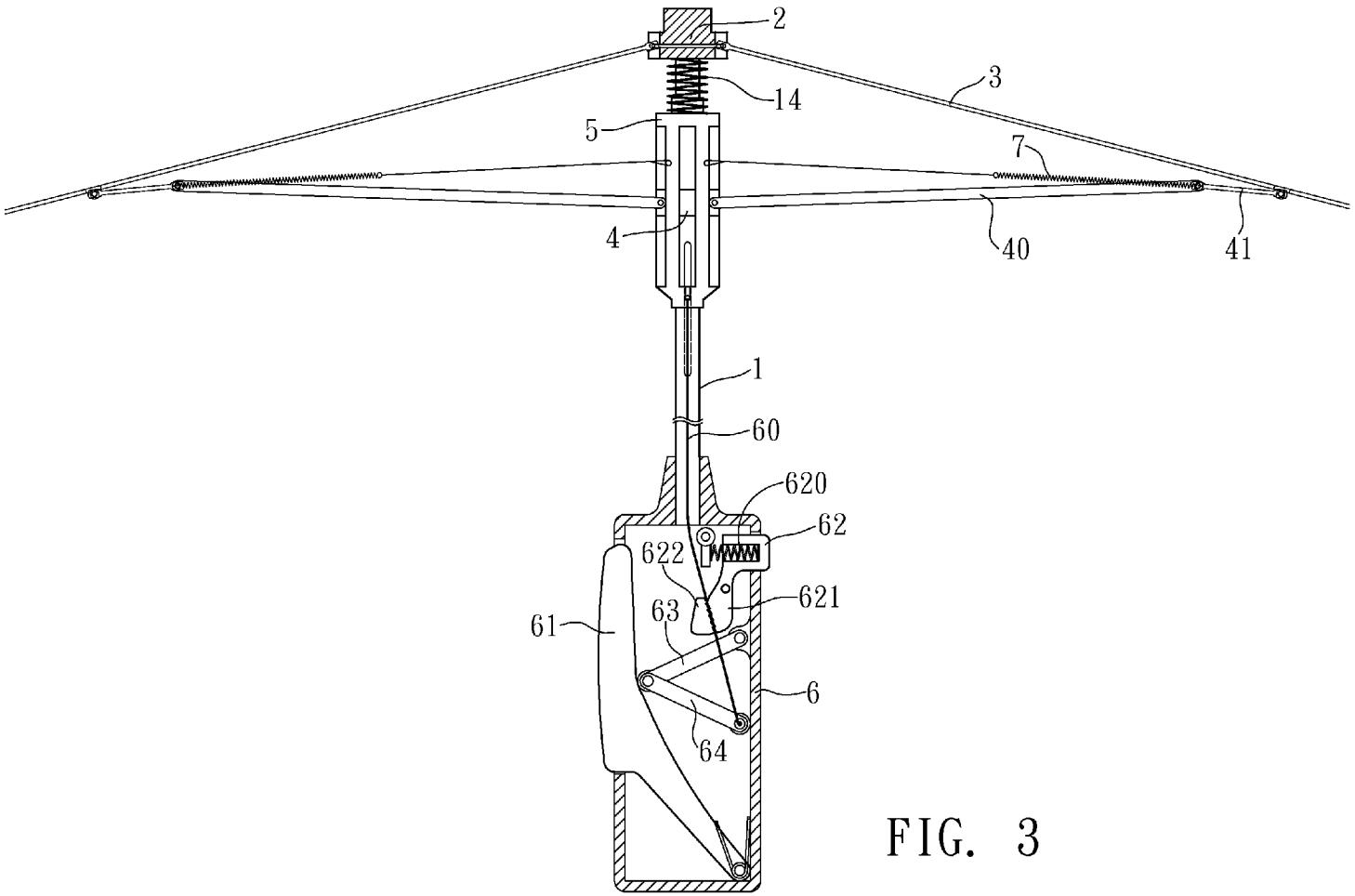
FIG. 3 is a schematic view of unfolding the umbrella in accordance with the first preferred embodiment of the present invention.
Figure 4:
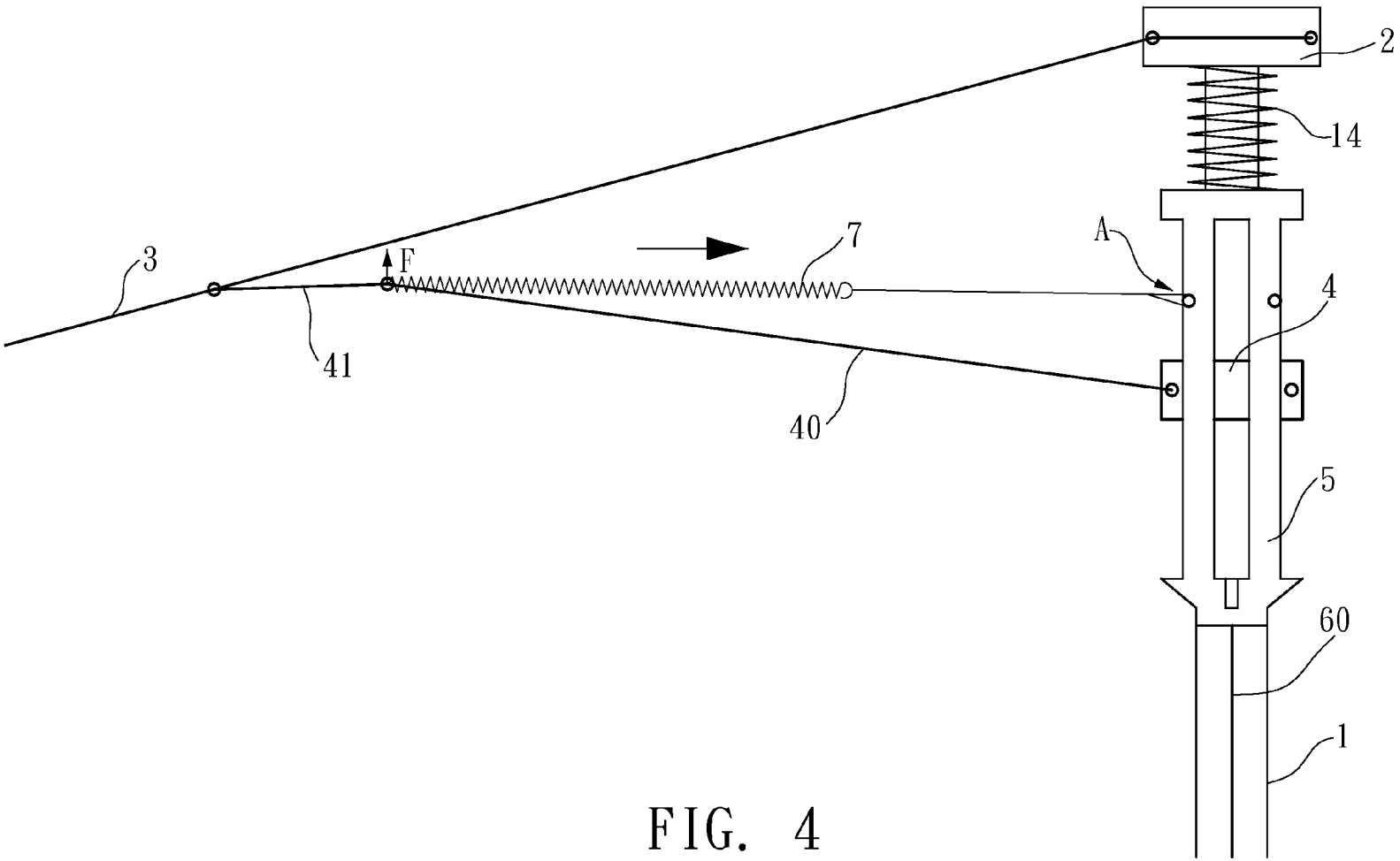
FIG. 4 is a schematic view of unfolding the umbrella ribs of the umbrella in accordance with the first preferred embodiment of the present invention.

As shown in FIG. 3, the umbrella is spread open, and the slide element 5 is pulled upwardly by the elastic element 14, and the elastically stretchable element 7 at a pivot point (hereinafter referred to as the "pivot point A") of the slide element 5 is now situated above the link rod base 4. In FIG. 4, the primary link rod 40 is maintained at the upwardly swinging position by an upwardly component force F of the elastically stretchable element. In FIG. 4, the angle for pivotally coupling the primary link rod 40 and the secondary link rod 41 exceeds 180 degrees at the upper part, so that when the umbrella ribs 3 are spread open, the umbrella ribs 3 are not completely pulled by the elastically stretchable element 7 only but also supported by the primary link rod 40 and the secondary link rod 41 in an effort saving manner. Now, the extension rod 64 is situated at an upward moving position to extend the press switch 61 outwardly towards the handle 6.

Figure 5:
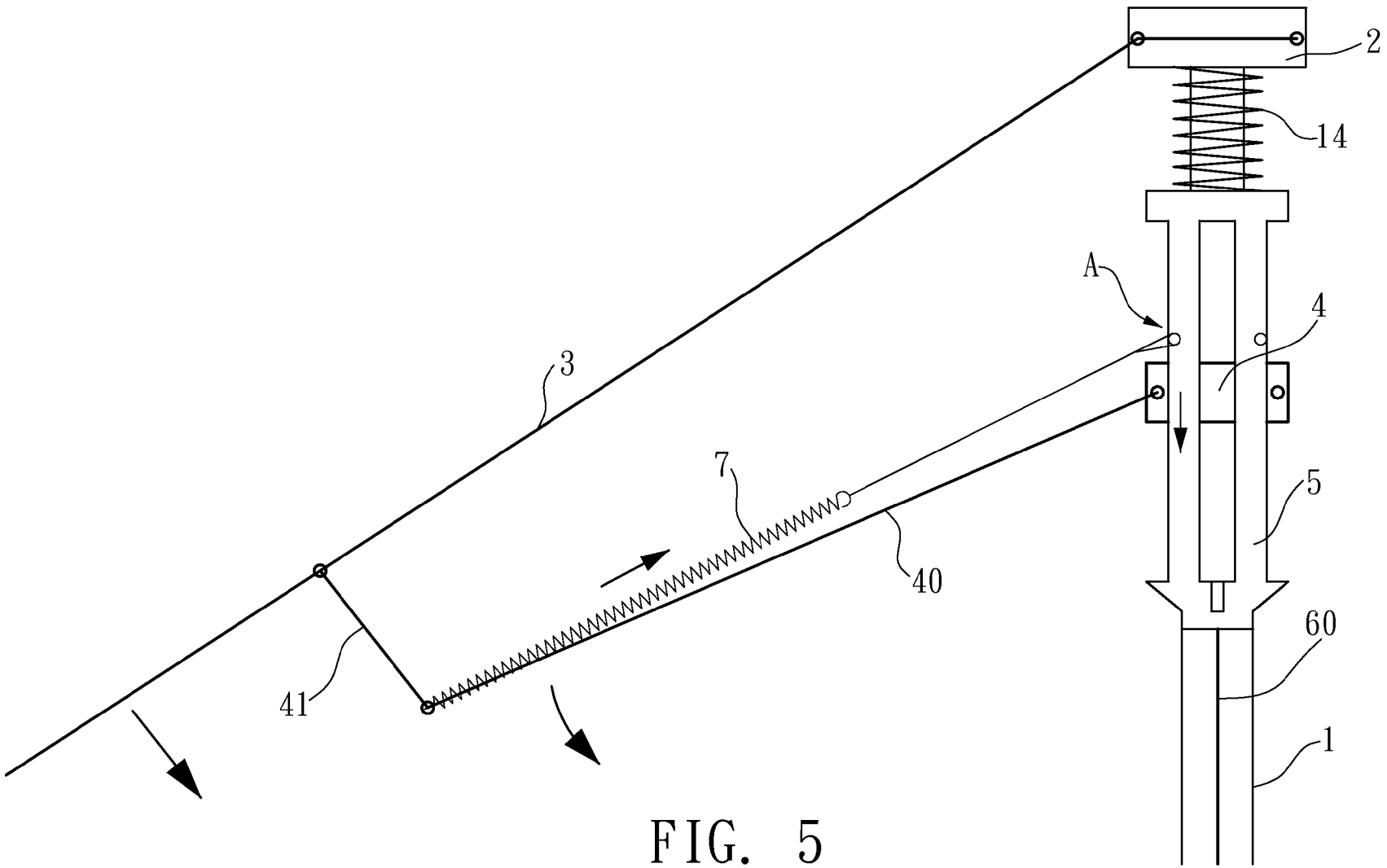
FIG. 5 is a schematic view of folding the umbrella when the umbrella ribs are halfway folded in accordance with the first preferred embodiment of the present invention.
Figure 6:
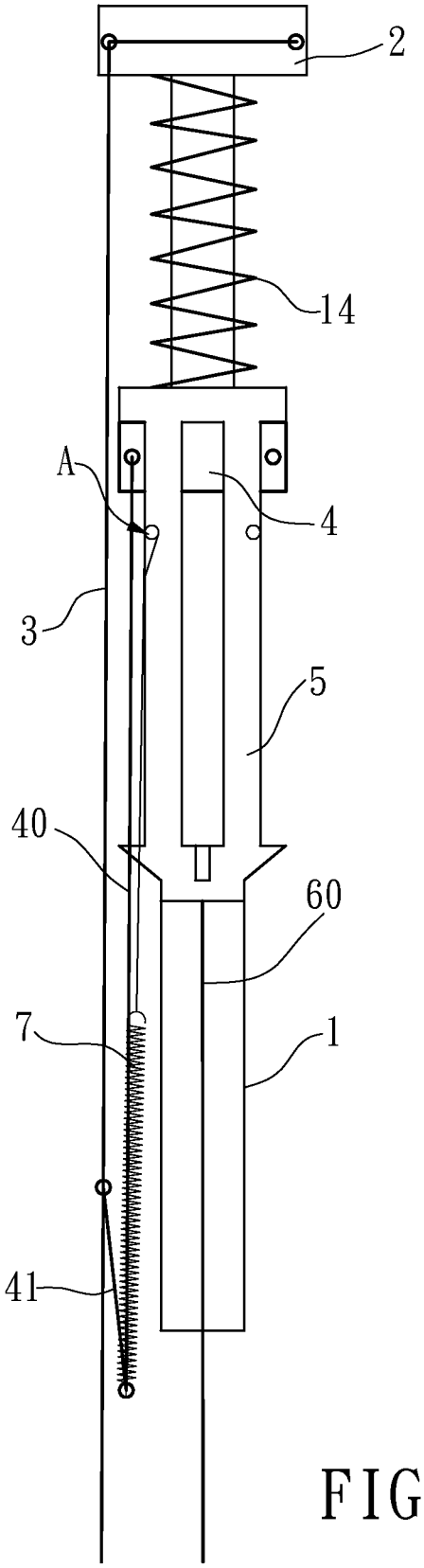
FIG. 6 is a schematic view of folding the umbrella when the umbrella ribs are fully folded in accordance with the first preferred embodiment of the present invention.

If it is necessary to fold the umbrella ribs 3, a user can press the press switch 61 towards the interior of the handle 6, such that the extension rod 64 is driven by the press switch 61 to move downward as shown in FIG. 5. Since the slide element 5 at the link element 60 is pulled to move downward, each elastically stretchable element 7 at the pivot point A of the slide element 5 is moved downward from the top of the link rod base 4. Now, the upward component force of each elastically stretchable element 7 is reduced gradually. Until the upward component force is smaller than the gravitational force of the primary link rod 40, each primary link rod 40 will start swinging downwardly to link each secondary link rod 41 and drive the umbrella rib 3 to bend downwardly till it is still as shown in FIG. 6. Now, each elastically stretchable element 7 is fully relaxed, and each umbrella rib 3 droops naturally into a folded state, and the link element 60 is situated at a downwardly pulled state and clamped by the clamp member 621 and the clamp base 622.

Figure 7:
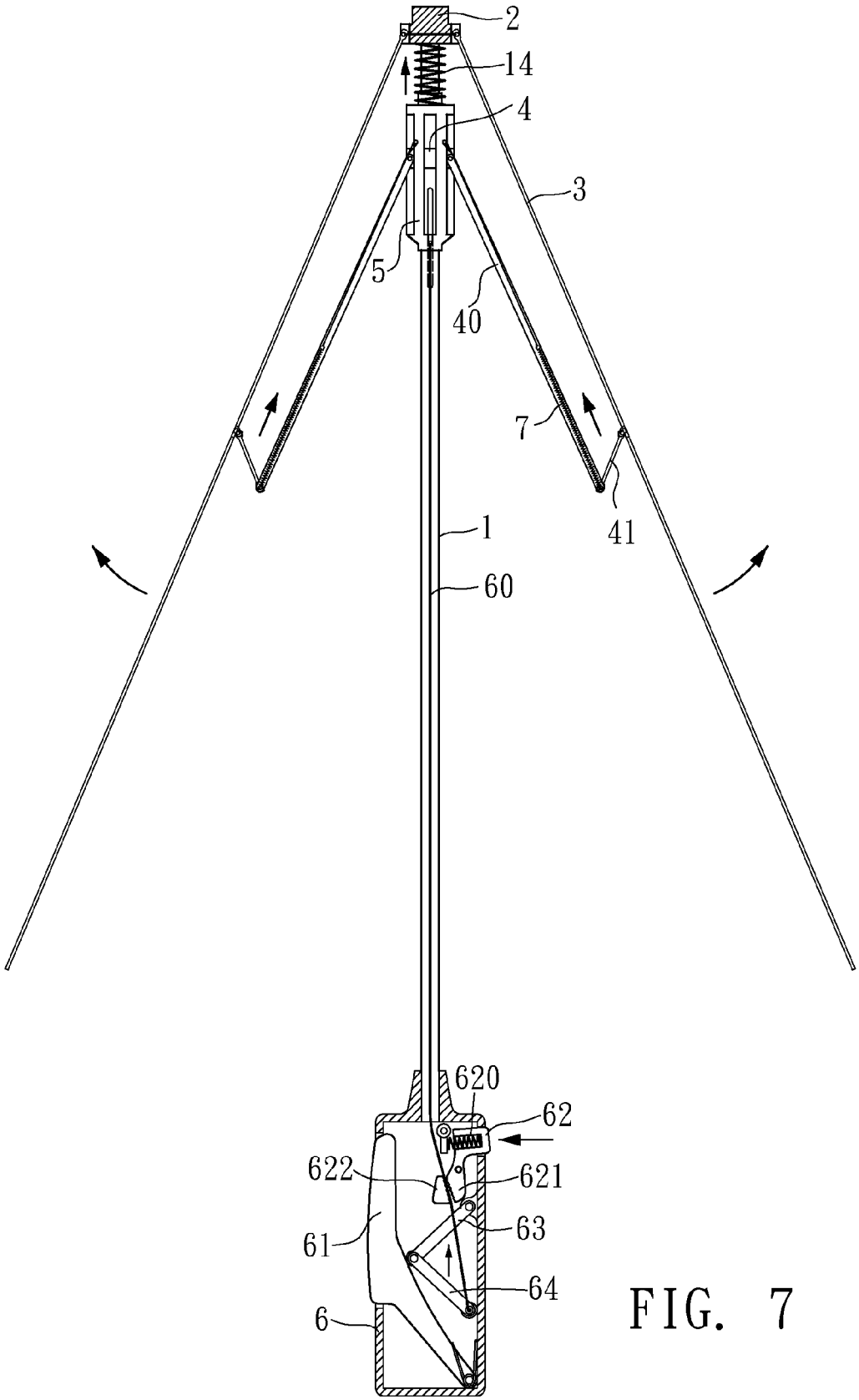
FIG. 7 is a schematic view of unfolding the umbrella ribs of the umbrella in accordance with the first preferred embodiment of the present invention.

If it is necessary to unfold the folded umbrella ribs 3 as shown in FIG. 7, the user simply needs to press the release switch 62 of the handle 6 to separate the link element 60 from the clamp member 621 and the clamp base 622, and the reaction of the elastic element 14 upwardly pulls back the slide element 5. When the elastically stretchable element 7 at the pivot point A of the slide element 5 is moved above the link rod base 4, each primary link rod 40 is pulled and lifted by the upward component force of the elastically stretchable element 7 to drive the secondary link rod 41 to spread open the umbrella rib 3.

Through the plurality of elastically stretchable elements 7 coupled between the slide element 5 and the primary link rod 40, and the umbrella ribs folded or unfolded by pressing the press switches 61, 62 respectively, the press switch 61 and the release switch 62 can be operated continuously by one hand of a user to repeat the folding and unfolding operations of the umbrella ribs. Obviously, the automatic folding/unfolding umbrella of the present invention provides a very convenient application, and simplifies the components of the conventional umbrella, so that the invention can concurrently take the effects of operating the umbrella conveniently and lowering the component cost effectively into account.

In this preferred embodiment, the elastic element 14 is a stretchable spring provided for producing a pulling force to the slide element 5, so that the slide element 5 has a reaction for resuming its original position. The elastic element of the present invention is not limited to the stretchable spring of this preferred embodiment only, but it also can be a compression spring. If the elastic element is the compression spring, the aforementioned link element 60 is a driving link rod capable of pushing the slide element 5 upwardly to open the umbrella. If the elastic element is the compression spring, a reaction is provided the slide element 5 to move downwardly to resume its original position. When the slide element 5 is pushed back downwardly by the elastic element, the umbrella can be folded.

Figure 8:
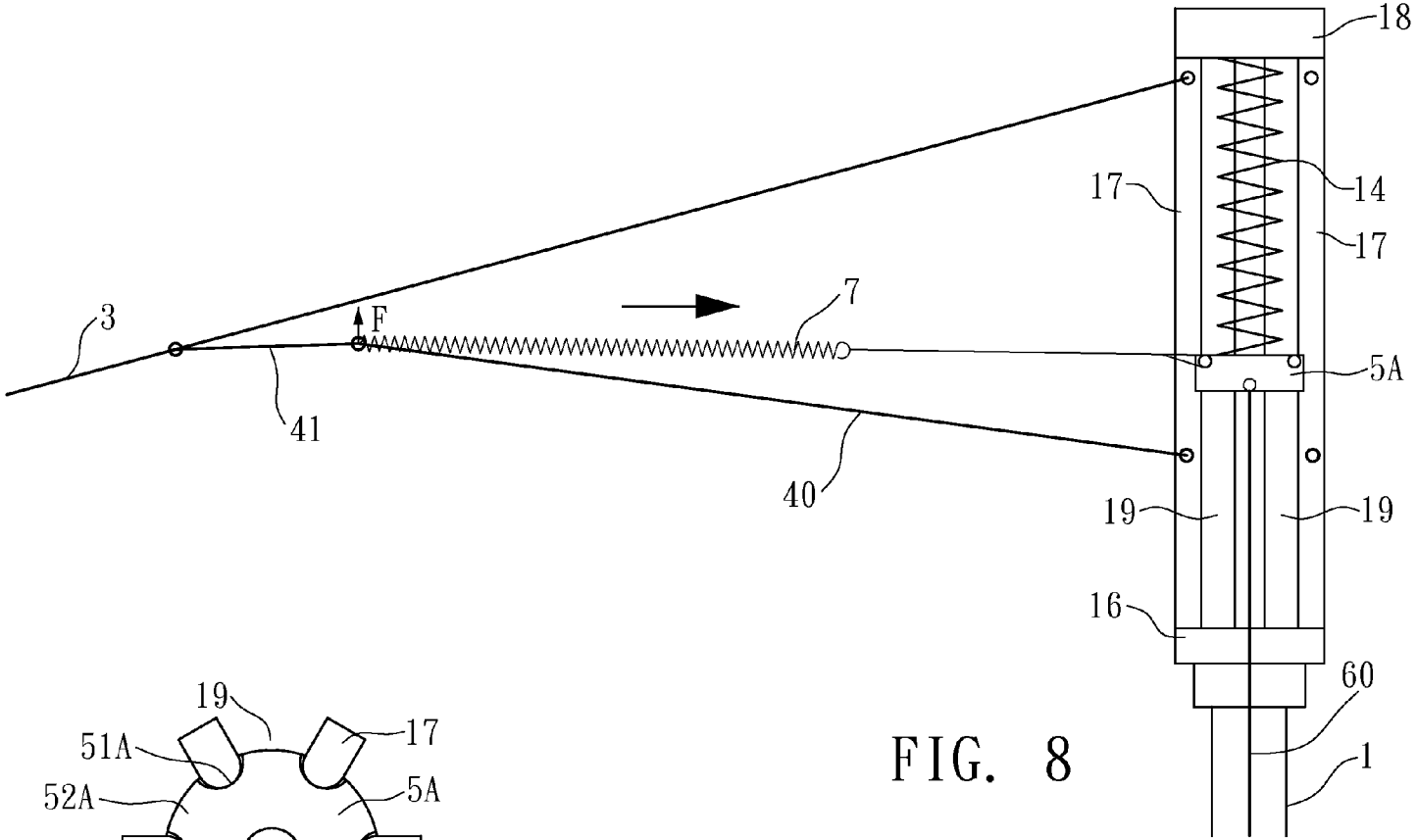
FIG. 8 is a schematic view of unfolding umbrella ribs of an umbrella in accordance with a second preferred embodiment of the present invention.
Figure 9:
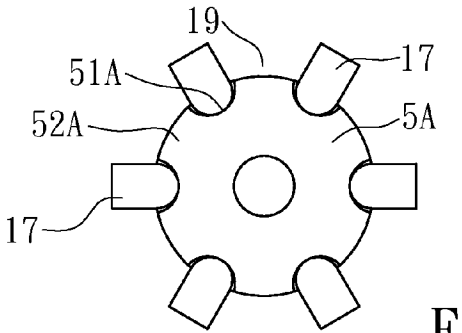
FIG. 9 is a schematic view of installing a link element and a plurality of guide posts of the umbrella in accordance with the second preferred embodiment of the present invention.

With reference to FIG. 8 for the second preferred embodiment of the present invention, a base 16 is formed at the tip of the main rod 1, and a plurality of guide posts 17 are circularly arranged and longitudinally erected from the base 16, and an upper cover 18 is installed at the top end of the plurality of guide posts 17, and the guide posts 17 are fixed between the base 16 and the upper cover 18, and a longitudinal long slot 19 is formed between any two adjacent guide posts 17. In FIGS. 8 and 9, a slide element 5A is longitudinally and slidably installed in the plurality of guide posts 17, and the slide element 5A is an elastic element 14 of the stretchable spring coupled between the slide element 5A and the upper cover 18, and the link element 60 is coupled to the slide element 5A, and the slide element 5A includes a plurality of inwardly concave grooves 51A formed around the slide element 5A, and each guide post 17 is disposed in the corresponding groove 51A, and the slide element 5A in each long slot 19 has a connecting portion 52A for pivotally coupling each elastically stretchable element 7, and each guide post 17 at a position proximate to upper cover 16 is pivotally coupled to each umbrella rib 3, and each guide post 17 below a position of pivotally coupling the umbrella ribs 3 is pivotally coupled to each primary link rod 40.

Figure 10:
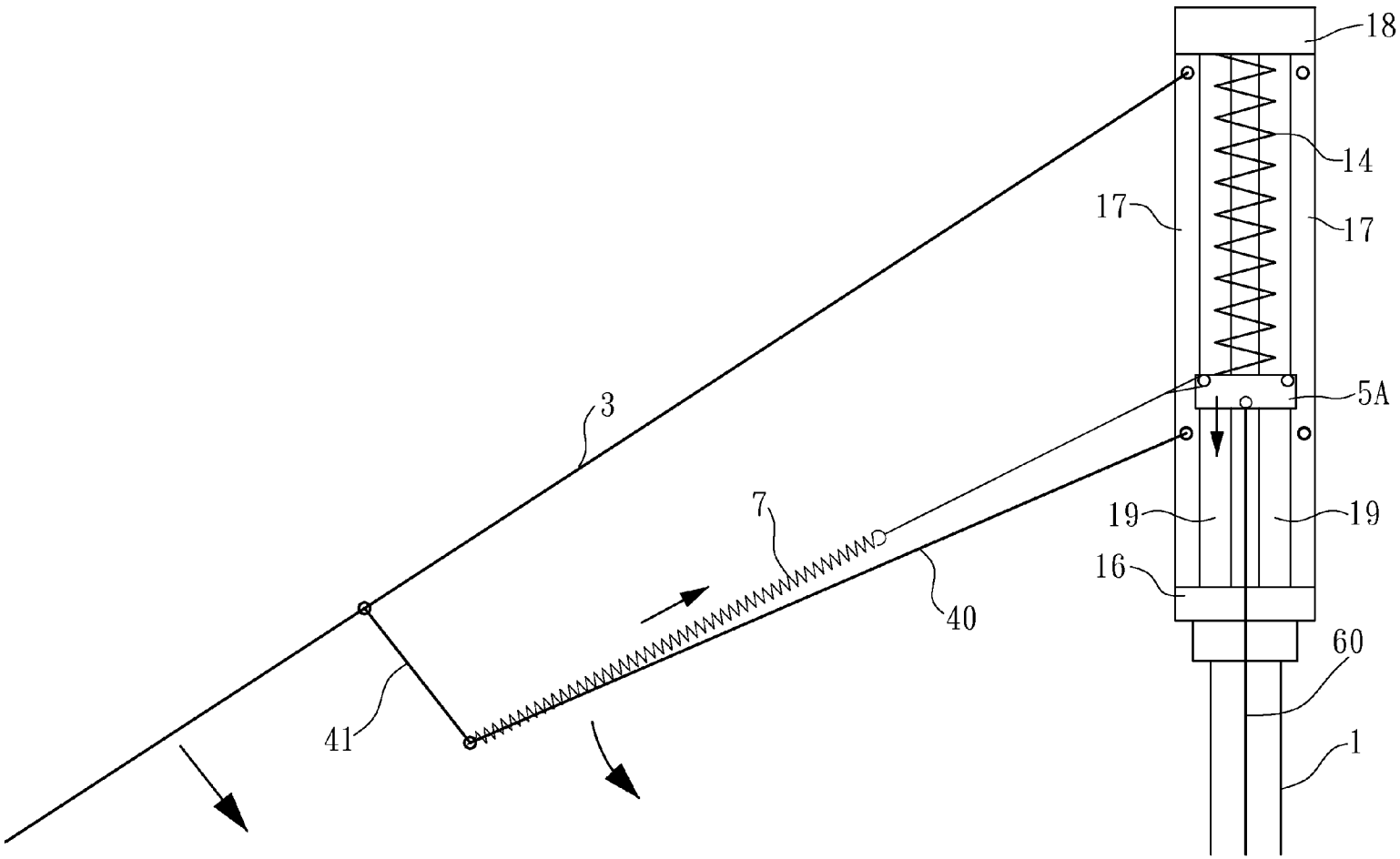
FIG. 10 is a schematic view of folding the umbrella when the umbrella ribs are halfway folded in accordance with the second preferred embodiment of the present invention.
Figure 11:
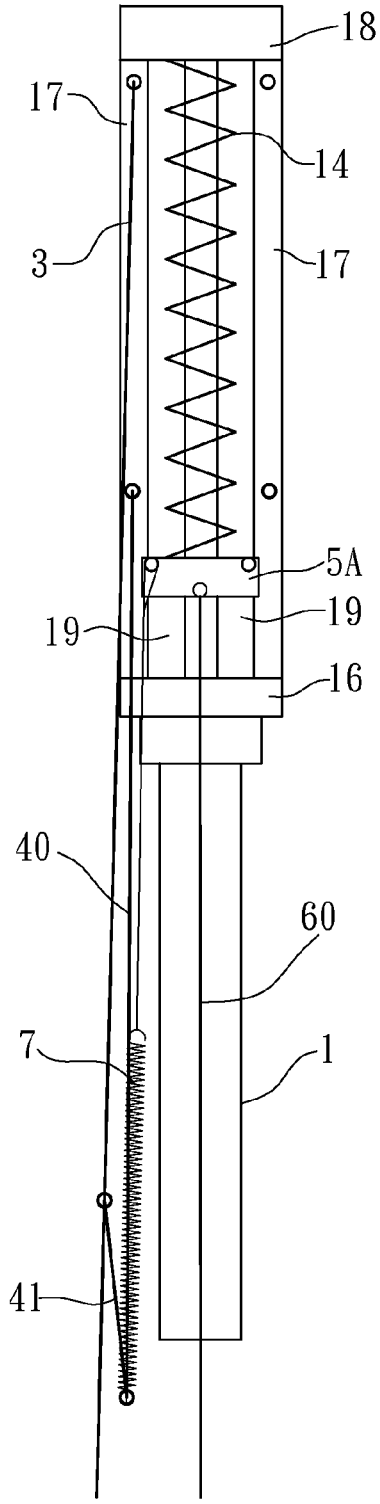
FIG. 11 is a schematic view of folding the umbrella when the umbrella ribs are fully folded in accordance with the second preferred embodiment of the present invention.

The main difference between this preferred embodiment and the first preferred embodiment resides on that the slide element 5 of the first preferred embodiment is installed on the external side of the main rod 1 and can slide longitudinally at the external periphery of the main rod 1, but the slide element 5A of this preferred embodiment is situated on the internal side of the main rod 1 (which is between the base 16 at top end of the main rod 1, the plurality of guide posts 17, and the upper cover 18) as shown in FIGS. 10 and 11, and the link element 60 and the elastic element 14 as described in the first preferred embodiment are used for driving the slide element 5A, such that the slide element 5A can slide longitudinally in the plurality of guide posts 17 to link the plurality of elastically stretchable elements 7 to displace between upper and lower positions wherein each guide post 17 is pivotally coupled to the primary link rod 40, so as to achieve the same effects of folding and unfolding the umbrella ribs as the first preferred embodiment. This preferred embodiment shows another implementation which is different from the first preferred embodiment of the present invention.

In addition, the slide element of the present invention is installed in the main rod 1 in accordance with this preferred embodiment, but it also can have a be plurality of long slots formed on the periphery of the main rod directly (similar to the long slots 10 formed on the main rod 1 in accordance with the first preferred embodiment), and the slide element (which is the slide element 5A of this preferred embodiment) is installed into the main rod directly. Similarly, a portion (which is the combining portion 52A of this preferred embodiment) of the long slot is exposed and coupled to the plurality of elastically stretchable elements (which are the elastically stretchable element 7 as described in the first and second preferred embodiments), and plurality of primary link rods (which are the primary link rods 40 as described in the first and second preferred embodiments) are pivotally coupled between the long slots at the periphery of the main rod (wherein the main rod includes a pivot lug protruded from the main rod for pivotally coupling the primary link rod). Regardless of the slide element 5 of the first preferred embodiment being installed on the external side of the main rod 1 or the slide element 5A of the second preferred embodiment being installed on the internal side of the main rod 1, these slide elements are intended to be covered within the scope of the present invention.

Figure 12:
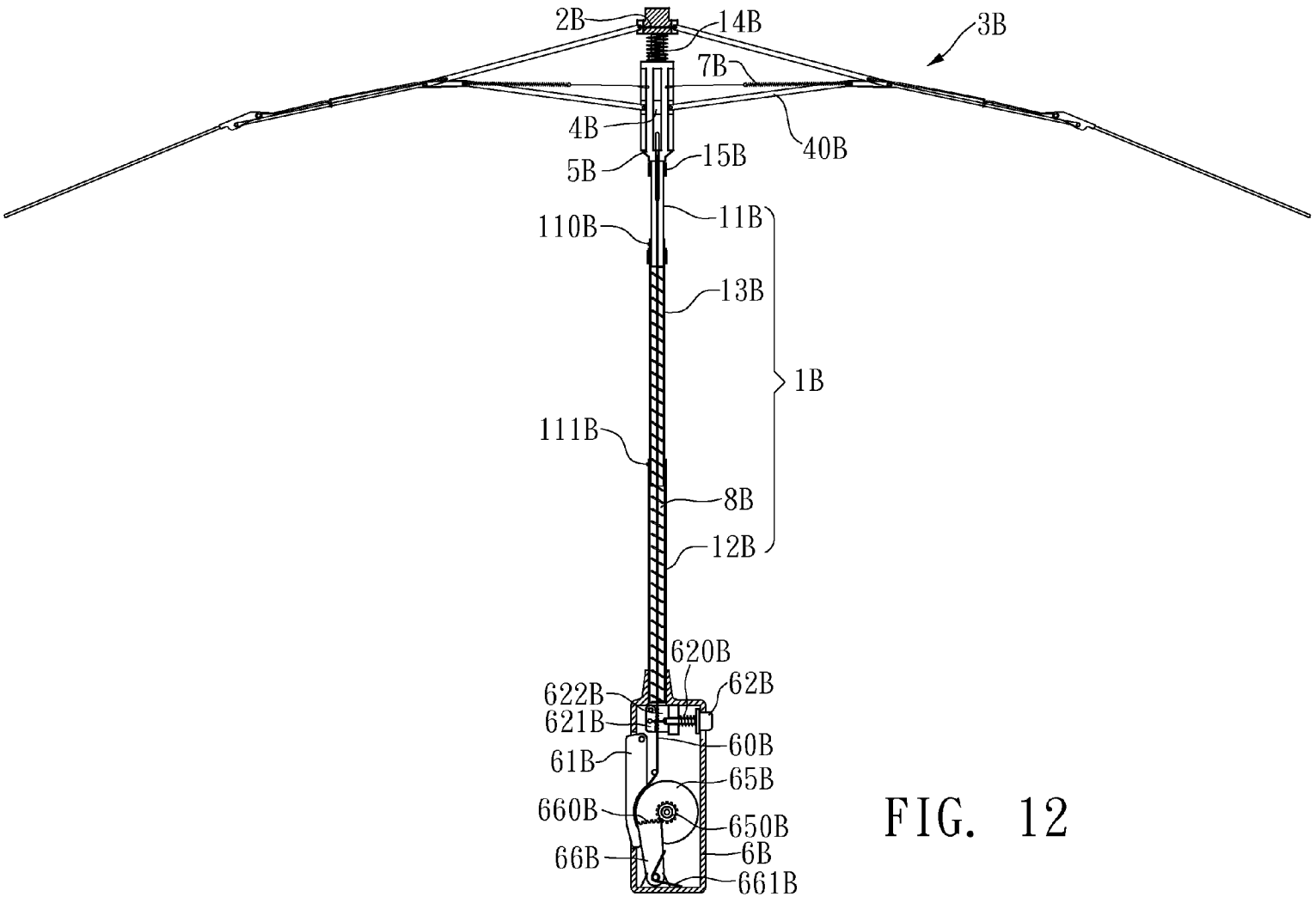
FIG. 12 is a schematic view of unfolding umbrella ribs of an umbrella in accordance with a third preferred embodiment of the present invention.

With reference to FIG. 12 for the third preferred embodiment of the present invention, a main rod 1B is composed of two or more rods coupled to one another, and the umbrella rib 3B is composed of two or more rods foldably coupled to one another, and the elastic element 14B is also a stretchable spring, and each main rod 1B has a different diameter, and the diameter of the rod of each main body 1B is tapered upwardly when the main rod 1B is extended. In this preferred embodiment, the main rod 1B includes an upper rod with the least diameter 11B, a lower rod with the greatest diameter 12B, and a middle rod 13B with a diameter falling within a range from the least diameter to the greatest diameter, and the umbrella rib base 2B, the plurality of umbrella ribs 3B, the link rod base 4B, and the slide element 5B are installed at the upper rod 11B, and the bottom of the lower rod 13B is coupled to the handle 6B, and both ends of a compressed elastic element 8B in the main rod 1B abut the bottom end of the upper rod 11B and the bottom end of the lower rod 12B respectively, and a latch 110B is installed at the upper rod 11B and proximate to the top end of the middle rod 13B, and another latch 111B is installed at the middle rod 13B and proximate to the top end of the lower rod 12, and a pressing element 15B is installed at the upper rod 11B. When the main rod 1B is shortened, the pressing element 15B abuts the latch 110B and the latch 111B to separate the latch 110B and the latch 111B, and the upper rod 11B drives the middle rod 13B to retract into the lower rod 12B.

The link mechanism includes a press switch 61B and a release switch 62B installed on the handle 6B, and the link element 60B is a string, and the link element 60B at an end of the handle 6B is wound around a rewind wheel 65B, and the rewind wheel 65B includes a gear 650B installed on a lateral side of the rewind wheel 65B for coaxially and unidirectionally driving the rewind wheel 65B to rotate. A turning element 66B is pivotally coupled to the bottom of the interior of the handle 6B, and the turning element 66B has a serration 660B formed at the top end of the turning element 66B and engaged with the gear 650B, and a torque spring 661B is installed between the turning element 66B and the handle 6B for controlling the turning element 66B to resume its original position after the turning element 66B is turned, and the handle 6B includes the press switch 61B installed on a lateral side of the turning element 66B for turning and moving the turning element 66B. After the press switch 61B is pressed and popped back by the torque spring 661B, the press switch 61B can be pressed again. The release switch 62B in the handle 6B is installed at the top of the rewind wheel 65B, and the release switch 62B in the handle 6B is pushed by a compression spring 620B, and an end of the release switch 62B is coupled to a clamp member 621B, and an end of the clamp member 621B is pivotally coupled to the handle 6B, and a clamp base 622B is disposed opposite to the internal side of the clamp member 621B, and the link element 60B is passed between the clamp member 621B and the clamp base 622B, and the clamp base 622B includes teeth formed on a side opposite to the clamp member 621B for clamping the link element 60B. When the press switch 61B is pressed, the turning element 66B is driven to turn the gear 650B to rotate counterclockwise. Now, the rewind wheel 65B and the gear 650B are rotated and wound synchronously. In other words, the link element 60B is rewound along the circumference of the rewind wheel 65B. When the turning element 66B is bounced back by the torque spring 661B to resume its original position, the gear 650B on the rewind wheel 65B idly rotates clockwise, and the rewind wheel will not rotate. The rewind wheel 65B will continue its operation according to the winding until the link element 60B stops to be pulled. Now, the link element 60B is clamped and fixed by the clamp member 621B and the clamp base 622B.

Figure 13:
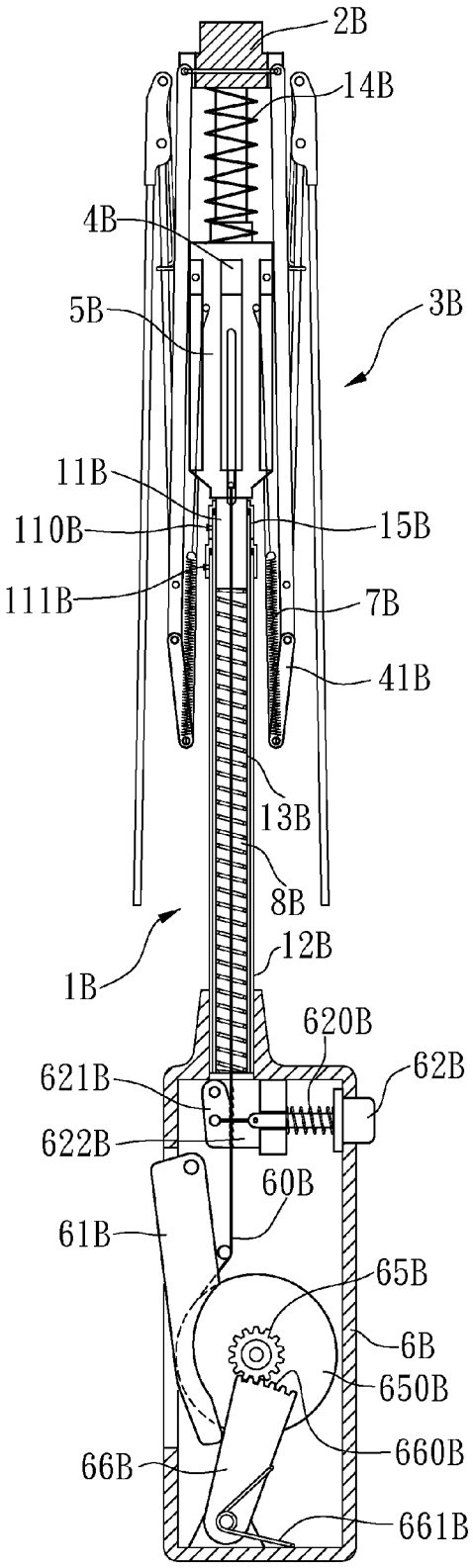
FIG. 13 is a schematic view of folding the umbrella ribs of the umbrella in accordance with the third preferred embodiment of the present invention.

When the umbrella is folded, the press switch 61B is pressed to pull the link element 60B all the way down to the bottom (wherein a multi-pressing operation is designed this preferred embodiment, so that the stroke of a single press of the link element 60B can be increased). For example, a gear set can be installed in the handle 6B, or a single press is provided for the winding operation), and a link element 60B links to fold the multi-section umbrella ribs 3B, and the pressing element 15B is moved downwardly to spread the latch 110B and the latch 111B sequentially to fold the main rod 1B. Now, the compressed elastic element 8B is compressed to the bottom as shown in FIG. 13. When the umbrella is opened, the release switch 62B is pressed to push away the clamp member 621B to separate the clamp base 622B, and the compressed elastic element 8B in the main rod 1 is extended and popped out, and the pop-out action extends the upper rod 11B and the middle rod 13B out from the lower rod 12B sequentially, and the upper rod 11B and the middle rod 13B are fixed by the latch 110B. The latch 111B installed between the middle rod 13B and the lower rod 12B is fixed, while the slide element 5B is pulled back by the elastic element 14B, such that the link element 60B together with the slide element 5B is pulled upward to move the elastically stretchable element 7 upward to open the umbrella, so as to resume the condition as shown in FIG. 12.

Figure 14:
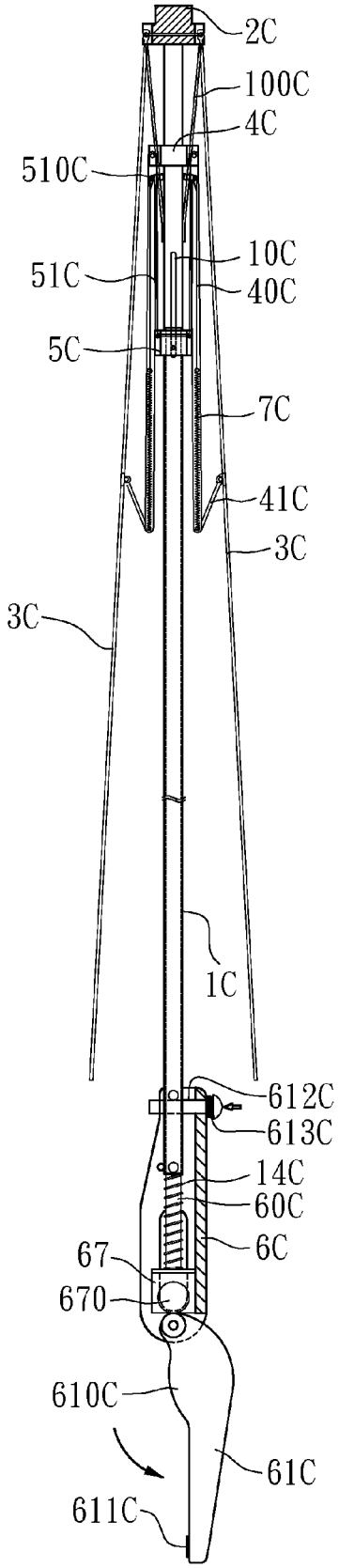
FIG. 14 is a schematic view of an umbrella in accordance with a fourth preferred embodiment of the present invention.
Figure 15:
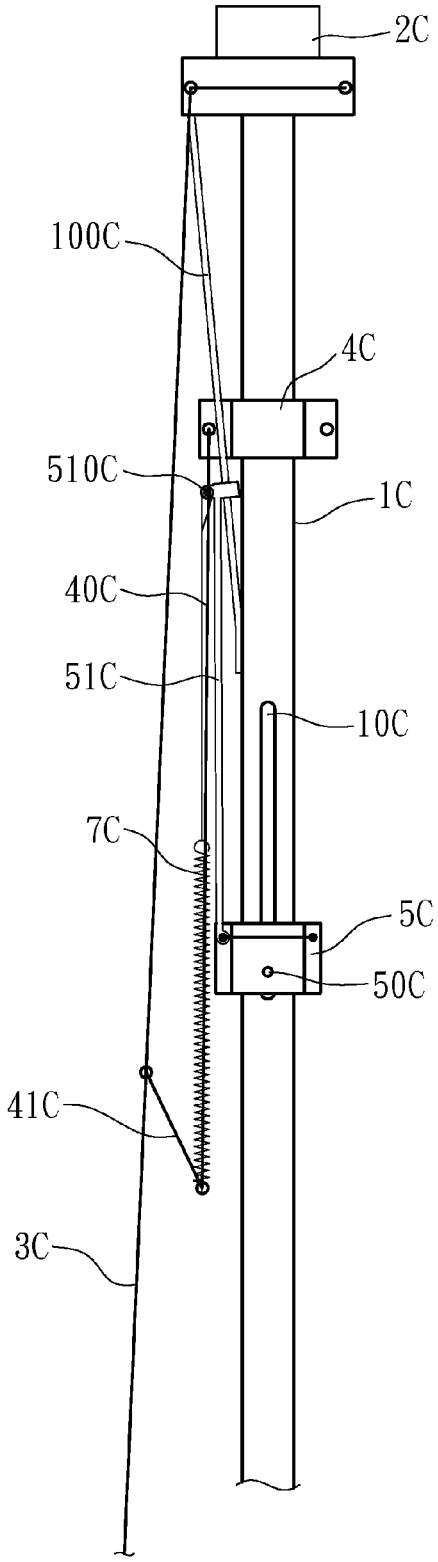
FIG. 15 is a schematic view of folding the umbrella ribs of the umbrella in accordance with the fourth preferred embodiment of the present invention.

With reference to FIGS. 14 and 15 for the fourth preferred embodiment of the present invention, this preferred embodiment main rod 1C, an umbrella rib base 2C, plurality of umbrella ribs 3C, a link rod base 4C, a slide element 5C, a handle 6C, and plurality of elastically stretchable elements 7C, wherein the main rod 1C is a single rod. The main difference resides on that the main rod 1C includes a plurality of guide rails 100C formed around the periphery of the link rod base 4C and corresponding to the plurality of elastically stretchable elements 7C respectively, and an end of each guide rail 100C above the long slot 10C is fixed to the main rod 1C, and another end of each guide rail 100C is fixed to the umbrella rib base 2C, and each guide rail 100C is extended gradually and obliquely from an end of the main rod 1C towards an end of the umbrella rib base 2C. The slide element 5C includes a plurality of guide rods 51C pivotally coupled to the periphery of the slide element 5C and corresponding to the plurality of guide rails 100C respectively, and each guide rod 51C is extended in a direction from the slide element 5C towards the umbrella rib base 2C, and each guide rod 51C includes a circular portion 510C formed at the top end of each guide rod 51C and slidably sheathed on the corresponding guide rail 100C, and each of the elastically stretchable elements 7C is coupled to the circular portion 510C of the corresponding guide rod 51C.

In this preferred embodiment, a press switch 61C is pivotally coupled to the bottom of the link mechanism, and an arc-protruding outer arc section 610C is formed on a side of the press switch 61C. After the press switch 61C can be pivotally swung to a lateral side of the handle, the outer arc section 610C is swung laterally towards the handle 6C, and a positioning spring 611C is installed between the press switch 61C and the handle 6C for fixing the press switch 61C, when the press switch 61C is pivotally swung to the lateral side of the handle 6C. The link element 60C of this preferred embodiment is an inner rod, extended longitudinally from the bottom end of the main rod 1C towards the handle 6C. The extended end of the inner rod is coupled to a driving portion 67C that can slide longitudinally in the handle 6C, and a freely rotating roller 670C is pivotally coupled to the driving portion 67C, and the press switch 61C on a lateral side of the handle 6C is provided for contacting the outer arc section 610C with the periphery of the roller 670C. When the press switch 61C on the lateral side of the handle 6C is swung sideway, and the link element 60C coupled to the driving portion 67C is driven by the elastic element 14C to slide up and down along the track of the outer arc section 610C.

The elastic element 14C of this preferred embodiment is a compression spring, and the link element 60C is installed in the handle 6C, and an end of the elastic element 14C abuts the driving portion 67C, and another end of the elastic element 14C abuts the bottom of the main rod 1C, and the press switch 61C is pressed towards the inside of the handle 6C, so that a track or the outer arc section 610C drives the driving portion 67C to move upward with the roller 670C, and the press switch 61C is moved outwardly towards the handle 6C, so that the driving portion 67C is pressed downwardly to resume its original position by the elastic element 14C. The positioning spring 611C of this preferred embodiment is a magnet, and the main rod 1C is made of metal that can be magnetically attracted. When the press switch 61C is pivotally moved to a lateral side of the handle 6C, the main rod 1C is magnetically attracted and fixed by the positioning spring 611C, and a pushing rod 612C is passed transversally through another side of the main rod 1C other than the side for magnetically attracting the positioning spring 611C, and an end of the pushing rod 612C is exposed from the magnetically attracted position of the main rod 1C and the positioning spring 611C, and the pushing rod 612C includes a compression spring 613C capable of resuming the pushing rod to its original position after being pressed. When the press switch 61C is pressed to magnetically attract the positioning spring 611C to the main rod 1C, the pushing rod 612C can be pressed to push away the magnetically attracted positioning spring 611C and the main rod 1C to fold the umbrella, and the pushing rod 612C can be pushed to pop out and resume its original position by the compression spring 613C.

Figure 16:
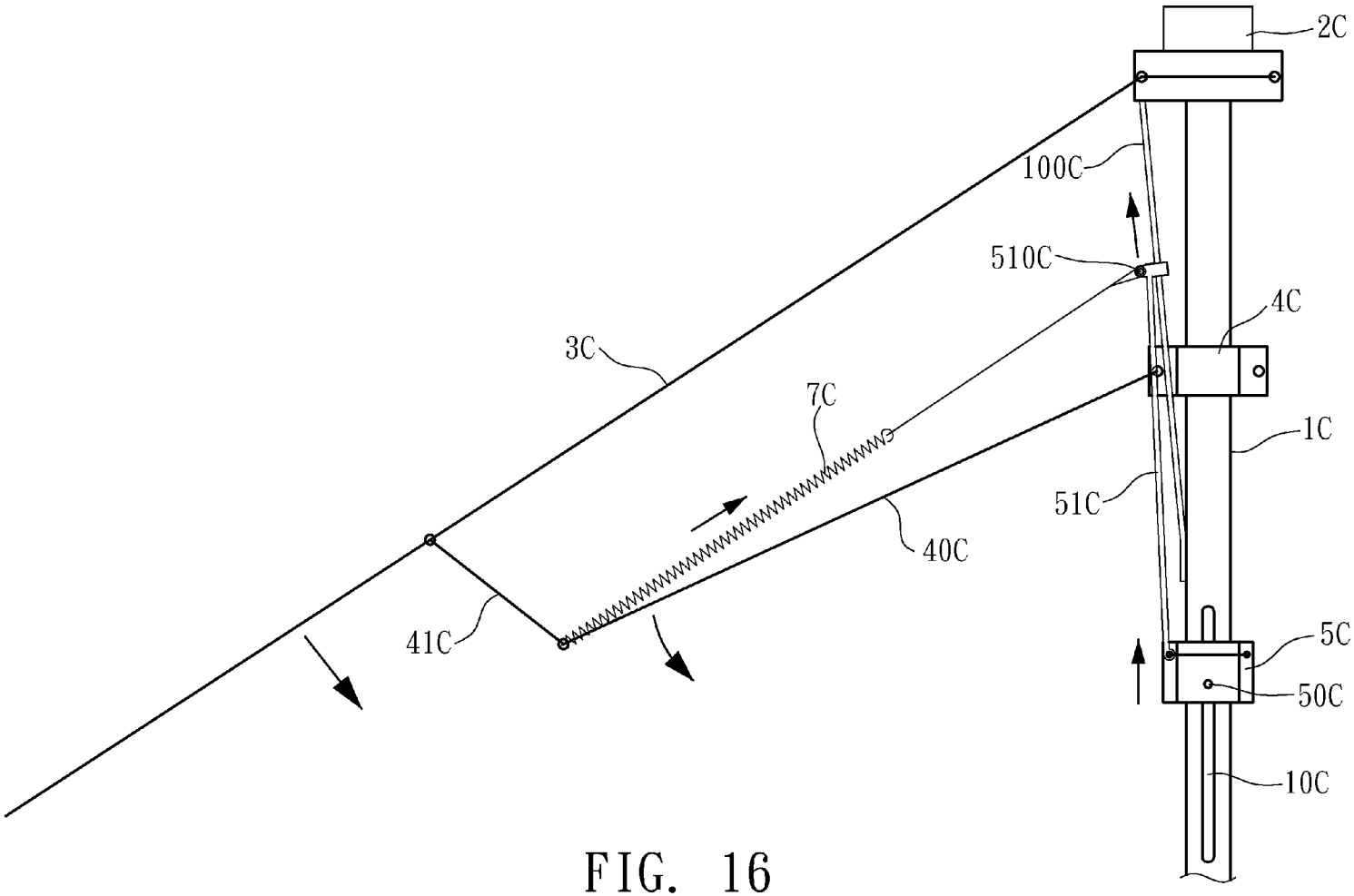
FIG. 16 is a schematic view of folding the umbrella when the umbrella ribs are halfway folded in accordance with the fourth preferred embodiment of the present invention.
Figure 17:
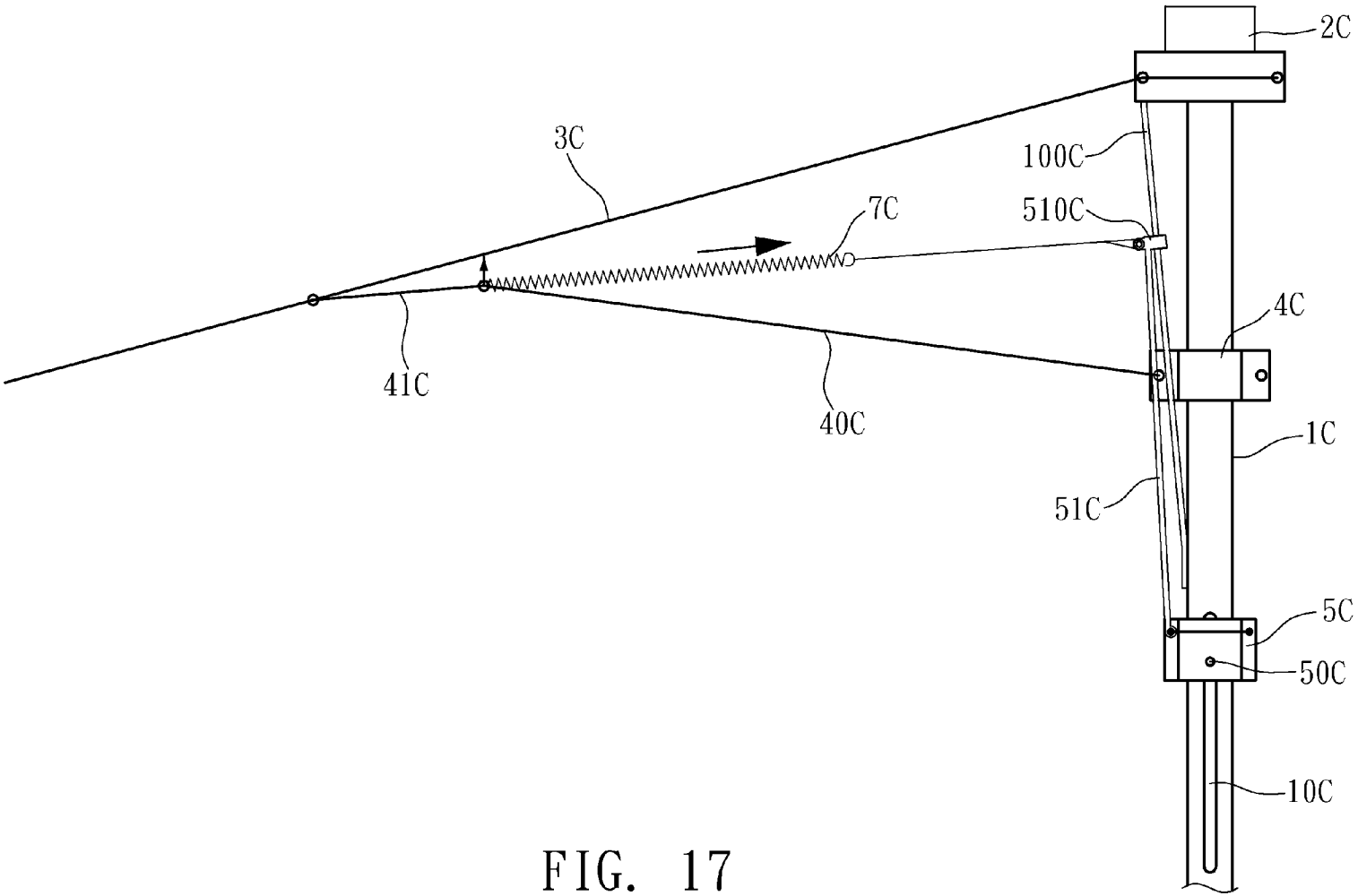
FIG. 17 is a schematic view of folding the umbrella when the umbrella ribs are fully folded in accordance with the fourth preferred embodiment of the present invention.
Figure 18:
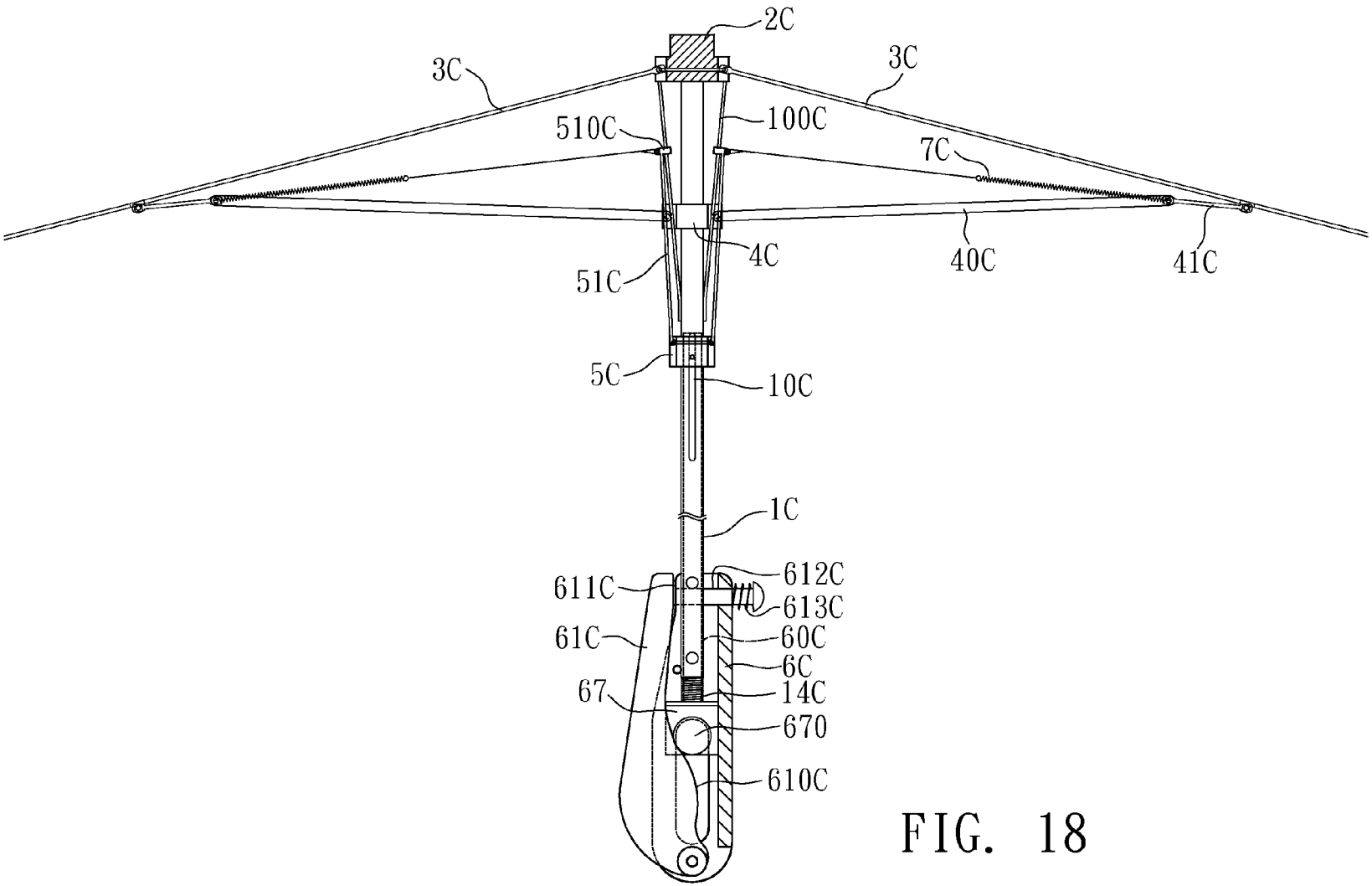
FIG. 18 is a schematic view of the unfolded umbrella in accordance with the fourth preferred embodiment of the present invention.

As shown in FIG. 16, when the slide element 5C slides together with the limit rod 50C from the bottom to the top, each guide rod 51C is swung gradually outward together with the circular portion 510C sheathed on the guide rail 100C, and each of the elastically stretchable elements 7C is also swung and moved outward together with the circular portion 510C at a position where the circular portion 510C is coupled, such that the lateral component force is produced when the elastically stretchable element 7C links with the circular portion 510C. Now, the elastically stretchable element 7C as shown in FIG. 17 can be pulled up and fixed with less effort to drive the primary link rod 40C and the secondary link rod 41C to swing upward, and the umbrella as shown in FIG. 18 is fully spread open. With the effect of opening an umbrella with a single hand in accordance with each of the foregoing preferred embodiments, the umbrella can be opened with less effort.

What is claimed is:

1. An automatic folding/unfolding umbrella, comprising:

a main rod, being a single rod or composed of two or more rods telescopically coupled to one another, the main rod having a tip and a bottom;

an elastic element mounted on the main rod adjacent to the tip;

a plurality of umbrella ribs, each rib having an end pivotally coupled to the tip of the main rod and the plurality of umbrella ribs being distributed around the main rod for supporting a canopy, each of the umbrella ribs being a single rod or composed of two or more rods foldably coupled to one another;

a plurality of primary link rods, one primary link rod supporting one umbrella rib and being installed under the tip of the main rod, and a distance between each umbrella rib and a corresponding primary link rod at a pivoting position of the main rod being fixed, and each primary link rod being swung in a direction of the corresponding umbrella rib;

a plurality of secondary link rods, each secondary link rod having an end pivotally coupled to an end of the primary link rod, and another end of each secondary link rod being pivotally coupled to an umbrella rib, and each secondary link rod linking to a corresponding umbrella rib when the primary link rod swings;

a slide element, axially and slidably installed at the main rod and capable of sliding between upper and lower positions where the main rod is pivotally coupled to the plurality of primary link rods, the elastic element being mounted between the tip of the main rod and the slide element;

a handle, installed at the bottom of the main rod and having a link mechanism with a torque spring for restoring the link mechanism, the link mechanism being coupled to the slide element in the main rod by at least one link element, the at least one link element driving the slide element to slide up and down along the main rod, and the slide element producing a reaction in a reverse direction to resume its original position when the slide element is linked by the elastic element to drive the link element; and a plurality of elastically stretchable elements, each elastically stretchable element corresponding to one primary link rod and having an end coupled to an end of one secondary link rod which is pivotally coupled to a primary link rod, and another end of each elastically stretchable element being coupled to the slide element, and each elastically stretchable element moving up and down with the slide element at a position where the main rod is pivotally coupled to the plurality of primary link rods;

wherein when the slide element moves upwardly with respect to the main rod, each elastically stretchable element coupled to an end of the slide element moves from a bottom position to a top position where the primary link rod is pivotally coupled, and each primary link rod is pulled and lifted by the elastically stretchable element to drive the secondary link rod to open the umbrella ribs; and when the slide element moves downwardly with respect to the main rod, each elastically stretchable element coupled to an end of the slide element moves from the top position to the bottom position where the primary link rod is pivotally coupled, and each primary link rod being swung downwardly to drive the secondary link rod to fold the umbrella ribs when an upward component force pulled by the elastically stretchable element disappears.

2. The automatic folding/unfolding umbrella of claim 1, wherein the main rod includes an umbrella rib base disposed at the tip of the main rod for pivotally coupling each umbrella rib, and the main rod includes a link rod base pivotally coupled to each primary link rod, and the distance between the umbrella rib base and the link rod base is fixed, and the main rod includes a long slot formed at an opposite position of the slide element and radially penetrated through the main rod, and a limit rod is penetrated into the slide element and passed through the long slot, and the limit rod is coupled to the link element in the main rod, and when the limit rod is situated under the long slot, each of the elastically stretchable elements coupling the slide element is positioned lower than the position where the link rod base is pivotally coupled to each primary link rod, and when the limit rod is moved upward underneath the long slot, the slide element is linked and moved upward, so that each of the elastically stretchable elements at the position of coupling the slide element is higher than the position where the link rod base is pivotally coupled to each primary link rod.

3. The automatic folding/unfolding umbrella of claim 2, wherein the slide element extends from the bottom of the main rod towards the link rod base, and when the slide element slides up and down along the main rod, each of the elastically stretchable elements slides linearly up and down.

4. The automatic folding/unfolding umbrella of claim 2, further comprising:

a plurality of guide rails connected to the link rod base and each guide rail matching an elastically stretchable element, and an end of each guide rail above the long slot being fixed to the main rod, and another end of each guide rail being fixed to the umbrella rib base, and each guide rail capable of expanding from an end of the main rod towards an end of the umbrella rib base; and a plurality of guide rods pivotally coupled to the slide element and each guide rod matching a guide rail, and each guide rod capable of extending from the slide element towards the umbrella rib base, and a circular portion being formed at a top end of each guide rod and slidably sheathed on a corresponding guide rail, and each of the plurality of elastically stretchable elements being coupled to a circular portion of each corresponding guide rod, and the slide element sliding from the bottom to the top, and each guide rod swinging outwardly with the circular portion sheathed on the guide rail, and each of the elastically stretchable element also swinging and moving outwardly with the circular portion, so that a lateral component force is produced when the elastically stretchable element is driven by the circular portion.

5. The automatic folding/unfolding umbrella of claim 1, wherein the main rod comprises:

a base formed beneath the tip of the main rod and the elastic element;

a plurality of guide posts with a top end circularly arranged and longitudinally erected on the base and having an upper cover installed at the top end of the plurality of guide posts, and fixed between the base and the upper cover;

a longitudinal long slot formed between any two adjacent guide posts provided for the slide element to slide longitudinally therein, and the elastic element being coupled between the slide element and the upper cover, and the link element being coupled to the slide element; and a plurality of inwardly concave grooves formed around the slide element, and each guide post being disposed in the corresponding groove, and a connecting portion being formed at the slide element in each corresponding long slot for pivotally coupling each of the elastically stretchable elements, and each guide post proximate to the upper cover being pivotally coupled to each umbrella rib, and each guide post at the bottom of a position of pivotally coupling the umbrella rib being pivotally coupled to each primary link rod.

6. The automatic folding/unfolding umbrella of claim 1, wherein the elastic element is a stretchable spring, and the link mechanism includes a press switch and a release switch installed at the handle, and the link element is a pull string, and an end of two extension rods in the handle can be slidably contacted to a sidewall of the press switch, and the torque spring presses against the press switch, and an end of an extension rod is upwardly and pivotally coupled to a fixed position of the handle, and an end of another extension rod an end is downwardly and slidably contacted to a sidewall of the handle and coupled to the bottom end of the link element bottom end;

the release switch in the handle is installed above the two extension rods, and the release switch in the handle is pushed by a compression spring, and the release switch includes a clamp member extended towards the bottom, and the link element includes a clamp base disposed opposite to the lateral side of the clamp member, and the link element is passed between the clamp member and the clamp base, and the clamp base and teeth formed on a side opposite to the clamp member for clamping the link element; when the press switch is pressed, the extension rod is driven to pull the link element downward, and when the link element stops being pulled, the clamp member and the clamp base are provided for clamping and fixing the link element, and the press switch is linked by the two extension rods and pressed inwardly, and the pressed release switch separates the clamp member from the clamp base, and the slide element is pulled back by the elastic element to pull the link element upward together with the slide element, and the press switch is moved outwardly together with the retracted two extension rods by the torque spring.

7. The automatic folding/unfolding umbrella of claim 1, wherein the link mechanism includes a press switch pivotally coupled to the bottom of the handle, and the press switch includes an arc-protruding outer arc section formed on a side of the press switch, such that after the press switch is pivotally swung to a lateral side of the handle, the outer arc section is swung sideway towards the handle, and a positioning spring is installed between the press switch and the handle for fixing the press switch, when the press switch is pivotally swung to the lateral side of the handle; the link element is an inner rod extended longitudinally from the bottom end of the main rod towards the handle, and a driving portion is coupled to the extended end of the link element and longitudinally slid in the handle, and a freely rotating roller is pivotally coupled into the driving portion, and the press switch at the lateral side of the handle is contacted with the periphery of the roller through the outer arc section, and when the press switch at the lateral side of the handle swings sideway, the link element coupled to the driving portion is driven by the elastic element to slide up and down with a track of the outer arc section.

8. The automatic folding/unfolding umbrella of claim 7, wherein the elastic element is a compression spring, and the link element is sheathed on the handle, and an end of the elastic element abuts the driving portion, and another end of the elastic element abuts the bottom end of the main rod, and the press switch is pressed towards the handle to drive the track of the outer arc section to move the driving portion upward with the roller, and the press switch moves outwardly towards the handle to drive the elastic element to press the driving portion down to resume its original position.

9. The automatic folding/unfolding umbrella of claim 7, wherein the positioning spring is a magnet, and the main rod is made of a metal that can be magnetically attracted, and when the press switch is pivotally swung to the lateral side of the handle, the press switch is magnetically attracted and fixed to the main rod by the positioning spring, and a pushing rod is passed transversally through the main rod from an end other than another side of the magnet for the magnetic attraction, and an end of the pushing rod is exposed from the main rod and provided for magnetically attracting the positioning spring, and the pushing rod includes a compression spring sheathed thereon for retracting the pushing rod and resume its original position after the pushing rod is pressed, and when the press switch is magnetically attracted to the main rod by the positioning spring, the pushing rod can be pressed to push away the magnetically attracted positioning spring and main rod to fold the umbrella, and the pushing rod can be pushed by the compression spring to pop out and resume its original position.

10. The automatic folding/unfolding umbrella of claim 1, wherein the link mechanism includes a press switch and a release switch installed on the handle, and the link element is a string, and the link element at an end of the handle is wound around a rewind wheel, and a gear is installed on a lateral side of the rewind wheel for coaxially and unidirectionally driving the rewind wheel to rotate; and a turning element is pivotally coupled to the bottom in the handle, and the turning element includes a serration formed at the top end of the turning element and engaged with the gear, and the torque spring is installed between the turning element and handle for controlling the turning element to resume its original position after the turning element is turned, and the handle includes the press switch installed on the lateral side of the turning element for turning the turning element to swing, and after the press switch is pressed, the torque spring is operated to bounce the press switch back for another press; the release switch of the handle is installed above the rewind wheel, and the release switch of the handle is pushed by a compression spring, and an end of the release switch is coupled to a clamp member, and the clamp member has an end pivotally coupled into handle, and a clamp base is formed opposite to the internal side of the clamp member, and the link element is passed between the clamp member and the clamp base, and one of the opposite sides of the clamp base and the clamp member has a plurality of teeth for clamping the link element; when the press switch is pressed, the turning element is driven to turn and rotate the gear, and the rewind wheel rotates with the gear, and the link element is rewound along the circumference of the rewind wheel, and after the link element stops being pulled, the clamp member and the clamp base are provided for clamping and fixing the link element.

11. The automatic folding/unfolding umbrella of claim 1, wherein the main rod is composed of two or more rods telescopically coupled to one another, and the elastic element is a stretchable spring, and each rod comes with a different diameter, and the rod is tapered upwardly when the main rod is extended, and the main rod comprises an upper rod with the least diameter and a lower rod with the greatest diameter, and the plurality of umbrella ribs, the link rod base, and the slide element are installed on the upper rod, and the bottom of the lower rod is coupled to the handle, and both ends of a compressed elastic element installed in the main rod abut the bottom end of the upper rod and the bottom end of the lower rod respectively, and the upper rod proximate to a rod below has a distal surface greater than a latch of the next rod, and when the main rod is shortened, the latch presses the top end of the next rod to drive the next rod into the lower rod, and the compressed elastic element is pressed downwardly by the upper rod to produce a reaction to help the upper rod to pop out.

* * * * *